US008564488B2

(12) United States Patent
Okui et al.

(10) Patent No.: US 8,564,488 B2
(45) Date of Patent: Oct. 22, 2013

(54) GLASS ANTENNA FOR VEHICLE

(75) Inventors: Takao Okui, Matsusaka (JP); Akihiro Noguchi, Tamaki (JP)

(73) Assignee: Central Glass Company, Limited, Ube-shi, Yamaguchi (JP)

( * ) Notice: Subject to any disclaimer, the term of this patent is extended or adjusted under 35 U.S.C. 154(b) by 943 days.

(21) Appl. No.: 12/650,711

(22) Filed: Dec. 31, 2009

(65) Prior Publication Data

US 2010/0201597 A1 Aug. 12, 2010

(30) Foreign Application Priority Data

Feb. 6, 2009 (JP) ..... 2009-025857
Nov. 18, 2009 (JP) ..... 2009-262964

(51) Int. Cl.
*H01Q 1/32* (2006.01)

(52) U.S. Cl.
USPC ..... 343/713

(58) Field of Classification Search
USPC ..... 343/711, 712, 713, 843
See application file for complete search history.

(56) References Cited

U.S. PATENT DOCUMENTS 6,292,150 B1 * 9/2001 Doi et al. ..... 343/713
6,441,791 B1 * 8/2002 Oka ..... 343/713
2004/0135731 A1 7/2004 Komatsu et al.
2004/0169605 A1 9/2004 Komatsu et al.
2005/0179593 A1 8/2005 Oshima et al.
2008/0129636 A1 6/2008 Surittikul et al.
2009/0189815 A1 * 7/2009 Hotta et al. ..... 343/700 MS

FOREIGN PATENT DOCUMENTS

JP 9-018221 A 1/1997
JP 2004-214819 A 7/2004
JP 2004-214820 A 7/2004
JP 2008-141765 A 6/2008
WO 03/105278 A1 12/2003

* cited by examiner

*Primary Examiner* — Robert Karacsony
(74) *Attorney, Agent, or Firm* — Westerman, Hattori, Daniels & Adrian, LLP

(57) ABSTRACT

To receiving satellite broadcasting waves, it is provided an antenna comprising: a first element connected to a first feed point of a hot side; a ground element connected to a second feed point of a ground side; a second element; and a third element. The second element is arranged substantially in parallel with the first element so as to be coupled to the first element. The third element is arranged to define a predetermined angle with the first element, with a vertex of the predetermined angle set to a vicinity of the first feed point and the second feed point. The first element has a linear shape so as to have an inductive property at a resonance frequency. The third element has a linear shape so as to have a capacitive property at the resonance frequency. The third element is connected to a ground-side end portion of the second element.

8 Claims, 7 Drawing Sheets

GLASS ANTENNA FOR VEHICLE

CLAIM OF PRIORITY

The present application claims priority from Japanese patent applications JP 2009-25857 filed on Feb. 6, 2009 and JP 2009-262964 filed on Nov. 18, 2009, the content of which is hereby incorporated by reference into this application.

BACKGROUND OF THE INVENTION

This invention relates to an antenna which is installed on a flat surface (or a slightly curved surface), and more particularly, to a circularly polarized antenna which is installed on a window glass for a vehicle and is suitable to receive satellite broadcasting signal.

Conventionally, as a planar antenna for satellite communication such as GPS satellite communication, XM satellite broadcasting, or Sirius satellite broadcasting, a microstrip antenna is widely known. The microstrip antenna is installed on a wide metal plate such as a metal roof of a vehicle, to thereby yield high reception performance both for radio waves arriving at a high elevation angle and for radio waves arriving at a low elevation angle.

Such a conventional microstrip antenna needs to be installed on a metal surface, and therefore has a difficulty in being installed on a window glass of a vehicle. However, mainly in view of vehicle designing, there is currently a need for an antenna for receiving satellite broadcasting waves which is installed on a window glass of a vehicle instead of on a body thereof. As such an antenna that is installed on a window glass of a vehicle instead of on a metal surface thereof, antennas disclosed in WO 2003/105278 A1, JP 2004-214820 A, JP 2004-214819 A, and JP 2008-141765 A are known.

The antennas installed on a window glass of a vehicle which are disclosed in WO 2003/105278A1, JP 2004-214820 A, and JP 2004-214819 A are coplanar antennas which may be formed only on one surface of a dielectric substrate. Such an antenna as described above requires a wide conductive area, and hence has a problem that visibility decreases when the antenna is installed on a window glass. The antenna described above has another problem that performance thereof decreases when the antenna is installed on a vehicle.

The antenna disclosed in JP 2008-141765 A is a microstrip antenna which is intended to be installed on a window glass, and has a problem that visibility of a view through the window glass decreases as in the cases of WO 2003/105278A1, JP 2004-214820 A, and JP 2004-214819 A.

SUMMARY OF THE INVENTION

This invention has been made to solve such problems as described above, and it is therefore an object of this invention to provide an antenna for receiving satellite broadcasting waves which can be installed on one of glass surfaces, has a simple configuration, does not decrease visibility, and can obtain desired reception performance.

A representative aspect of this invention is as follows. That is, there is provided an antenna comprising: a first element connected to a first feed point of a hot side; a ground element connected to a second feed point of a ground side; a second element; and a third element. The second element is arranged substantially in parallel with the first element so as to be electromagnetically coupled to the first element. The third element is arranged to define a predetermined angle with the first element, with a vertex of the predetermined angle set to a vicinity of the first feed point and the second feed point. The first element has a linear shape so as to have an inductive property at a predetermined resonance frequency. The third element has a linear shape so as to have a capacitive property at the predetermined resonance frequency. The first feed point and the second feed point are arranged close to each other. The third element is connected to a ground-side end portion of the second element.

According to the antenna of this invention, the first element having the inductive property and the third element having the capacitive property are arranged at the predetermined angle with the vertex thereof set to the feed point. Thus, it is possible to provide the antenna for receiving satellite broadcasting waves which can be installed on one of glass surfaces and has a simple configuration. Further, it is possible to provide the high-performance and small-sized antenna, which does not decrease visibility or degrade the appearance even when the antenna is installed on the window glass.

BRIEF DESCRIPTION OF THE DRAWINGS

The present invention can be appreciated by the description which follows in conjunction with the following figures, wherein.

DETAILED DESCRIPTION OF THE PREFERRED EMBODIMENTS

Hereinafter, description is given of an antenna according to exemplary embodiments of this invention.

(First Embodiment)

Figure 1:
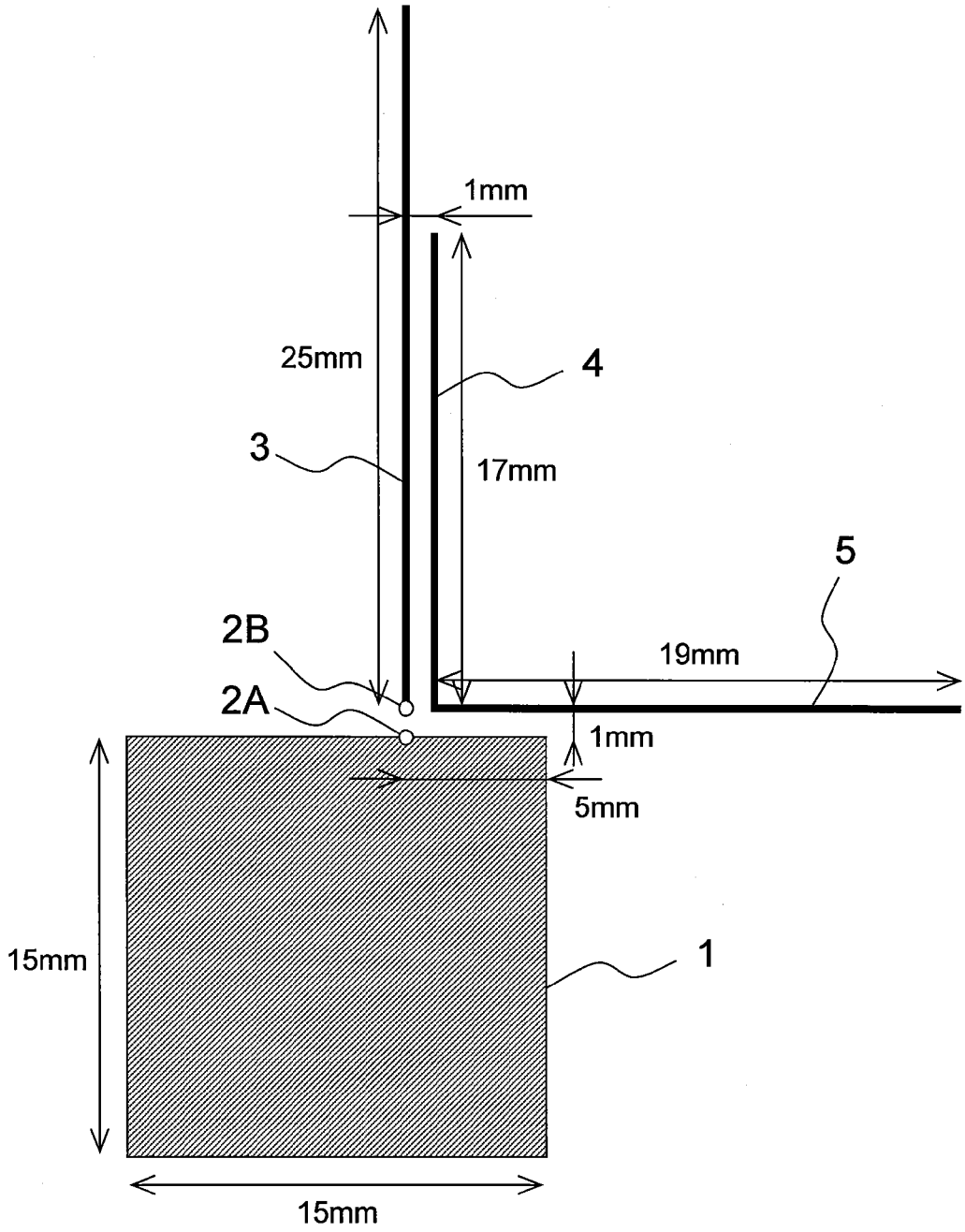
FIG. 1 is an explanatory diagram illustrating a configuration of an antenna according to a first embodiment of this invention.

FIG. 1 is an explanatory diagram illustrating a configuration of an antenna according to a first embodiment of this invention.

The antenna according to the first embodiment of this invention comprises a ground element 1, a first element 3, a second element 4, and a third element 5.

The ground element 1 has, for example, a substantially square shape as illustrated in FIG. 1. A second feed point 2A of a ground side is connected to the upper side of the ground element 1. It should be noted that the ground element 1 may have a polygonal shape other than the square shape as long as the ground element 1 has a certain size of area and has a conductive part which is close to the third element 5. Further, the ground element 1 may be a wire element, and is desirably a planar conductor.

The first element 3 is a linear wire conductor extending from a first feed point 2B of a hot side, which is provided at a position opposed to the position of the second feed point 2A of the ground side, in a direction in which the first element 3 departs from the ground element 1. In the example of FIG. 1, the angle defined between the first element 3 and one side (upper side) of the ground element 1 is 90 degrees, but the angle is not necessarily 90 degrees. As described later, the angle may be determined based on a phase delay between a current induced in the first element 3 and a current induced in the third element 5.

The second element 4 is a linear wire conductor arranged close to and in parallel with the first element 3. In the example of FIG. 1, the distance between the second element 4 and the first element 3 is 1 millimeter. Therefore, the second element 4 and the first element 3 are electromagnetically coupled to each other, with the result that a high frequency current induced in the first element 3 is also induced in the second element 4 and flows through the second element 4.

The third element 5 is a linear wire conductor arranged close to and in parallel with the one side of the ground element 1 and extending from the lower end (end portion on a side of the ground element 1) of the second element 4. In the example of FIG. 1, the distance between the third element 5 and the ground element 1 is 1 millimeter. The left end (end portion on a side of the first and second feed points 2B and 2A) of the third element 5 and the lower end (end portion on the side of the ground element 1) of the second element 4 are connected to each other, and hence the high frequency current flowing through the second element 4 also flows through the third element 5.

Next, description is given of dimension of each of the elements of the antenna according to this embodiment.

The length of the first element 3 of the antenna according to the first embodiment is desirably set larger than ¼ of a center frequency (resonance frequency) $\lambda$ of a reception band and smaller than $\lambda/3$, approximately. On the other hand, the length of the third element 5 is desirably set slightly smaller than $\lambda/4$. In other words, the length of the third element 5 is set smaller than the length of the first element 3.

Further, the second element 4 may take any value for its length as long as the second element 4 is shorter in length than the first element 3, and may be set to approximately $\lambda/5$, which indicates the length smaller than the length of the third element 5. This is because the strength of electromagnetic coupling between the second element 4 and the first element 3 changes depending on the length of the second element 4 and therefore the second element 4 may take any value for its length as long as its length is sufficient to make electromagnetic coupling to the first element 3.

In the antenna illustrated in FIG. 1, the length of each of the elements is set so that the antenna resonates at approximately 2.3 gigahertz. Specifically, the ground element 1 is shaped in 15 millimeters square. Further, length of the first element 3 is 25 millimeters, length of the second element 4 is 17 millimeters, and length of the third element 5 is 19 millimeters.

It should be noted that the antenna according to this embodiment is patterned on a surface of a window glass of a vehicle on a cabin side thereof, and hence the length of each of the elements is calculated under a condition that a wavelength contraction ratio $\alpha$ a due to glass is 0.7.

Next, description is given of a principle of operation of the antenna according to the first embodiment.

As described above, the first element 3 has one end connected to the first feed point 2B of the hot side, and the other end opened (unconnected), to thereby function as a monopole antenna. Further, the length of the first element 3 is larger than $\lambda/4$, and hence the first element 3 is inductive with respect to the center frequency. Therefore, the phase of the current induced in the first element 3 is delayed as compared with the phase of the voltage. Moreover, the length of the third element 5 is smaller than $\lambda/4$, and hence the third element 5 is capacitive with respect to the center frequency. Therefore, the phase of the current induced in the first element 3 is advanced as compared with the phase of the voltage.

Accordingly, when a high frequency voltage is applied to each of the first feed point 2B and the second feed point 2A, the current induced in the first element 3 is delayed as compared with the current induced in the third element 5. Thus, the plane of polarization of a radio wave to be radiated from (received by) the antenna according to this embodiment rotates in a direction from the first element 3 to the third element 5.

Similarly, the plane of polarization of a radio wave to be received by the antenna according to this embodiment rotates in the direction in which the radio wave propagates from the first element 3 toward the third element 5. In a case where the direction from which the radio wave to be received arrives is from the rear side of the sheet of FIG. 1 to the front side thereof, the antenna according to this embodiment is suitable to receive an radio wave of left-handed (counter clockwise) circular polarization. On the other hand, in a case where the direction from which the radio wave to be received arrives is from the front side of the sheet of FIG. 1 to the rear side thereof, the antenna according to this embodiment is suitable to receive an radio wave of right-handed (clockwise) circular polarization.

A phase difference between the first element 3 and the third element 5 is determined based on the inductive property of the first element 3 and the capacitive property of the third element 5, in other words, a difference between the length of the first element 3 and the length of the third element 5. When the length of the first element 3 and the length of the third element 5 are set so that the difference between the phase of the current induced in the first element 3 and the phase of the current induced in the third element 5 is $\pi/2$, a desired angle defined between the first element 3 and the third element 5 is 90 degrees.

The second element 4 may take any value for its length as long as the length is sufficient to make electromagnetic coupling to the first element 3 and does not affect characteristics of the first element 3. As a result of the experiment conducted by the inventors of this invention, it is desirable that the length of the second element 4 be approximately $\alpha \cdot \lambda/5$.

As described above, the third element 5 is arranged close to the one side of the ground element 1, and hence the third element 5 and the ground element 1 are electromagnetically coupled to each other. The electromagnetic coupling between the third element 5 and the ground element 1 may be weaker than the electromagnetic coupling between the first element 3 and the second element 4.

This is because the strength of the electromagnetic coupling between the third element 5 and the ground element 1 affects an input impedance of the antenna, with the result that the value of the impedance changes. It should be noted that, as a result of the experiment conducted by the inventors of this invention, it is desirable that the distance between the third element 5 and the ground element 1 range from 0.5 to 2 millimeters.

As described above, the ground element 1 is connected to the second feed point 2A of the ground side, to thereby function as a ground plane. The size of the ground element 1 is desirably determined in consideration of balance with the characteristics (for example, length) of the first element 3. In other words, the antenna according to this embodiment is an antenna for receiving satellite broadcasting waves, and hence needs to obtain an isotropic directivity in all directions on a plane. Therefore, an energy of the received radio wave which is induced in the first element 3 needs to be balanced with an energy of the received radio wave which is induced in the third element 5.

It should be noted that, in a case where the ground element 1 has a square shape, as a result of the experiment conducted by the inventors of this invention, it is desirable that the length of one side of the ground element 1 range from $\alpha\cdot\lambda/9$ to $\alpha\cdot\lambda/4$, approximately.

The ground element 1 may have any shape other than the square shape as illustrated in FIG. 1 as long as the ground element 1 has an area for ensuring the isotropic directivity and at least has, as a conductive part, one side close to and electromagnetically coupled to the third element 5.

Hereinabove, as the antenna according to the first embodiment, the description has been given of the glass antenna formed by baking a conductor on ceramic paste provided on a glass surface of a vehicle through screen printing. Alternatively, the pattern may be formed on other insulators. For example, the antenna may be installed on a window glass, a wall, or a roof of a building. Further, the antenna may have a pattern formed on a film which may be attached to a window glass of a vehicle.

Further, the description has been given of the antenna in which the third element 5 extends rightward from the vicinity of the first feed point 2B. Alternatively, in a line-symmetric manner with respect to the antenna illustrated in FIG. 1, the third element 5 may extend leftward from the vicinity of the first feed point 2B.

As described above, with the antenna according to the first embodiment, the first element having the inductive property and the third element having the capacitive property are arranged at the predetermined angle with the vertex thereof set to the first feed point. Thus, no large ground plane is necessary, and accordingly it is possible to provide the circularly polarized antenna which can be installed on a window glass.

Further, the antenna according to the first embodiment is configured mainly by linear elements, and hence, as compared with a microstrip antenna, it is possible to provide the high-performance and small-sized antenna, which does not decrease visibility or degrade the appearance even when the antenna is installed on a window glass.

Further, the ground element is arranged at the position opposed to the position of the first element across the first feed point, and thus the isotropic directivity is obtained in the plane direction. Accordingly, it is possible to provide the antenna which is suitable to receive satellite broadcasting waves.

(Second Embodiment)

Figure 2:
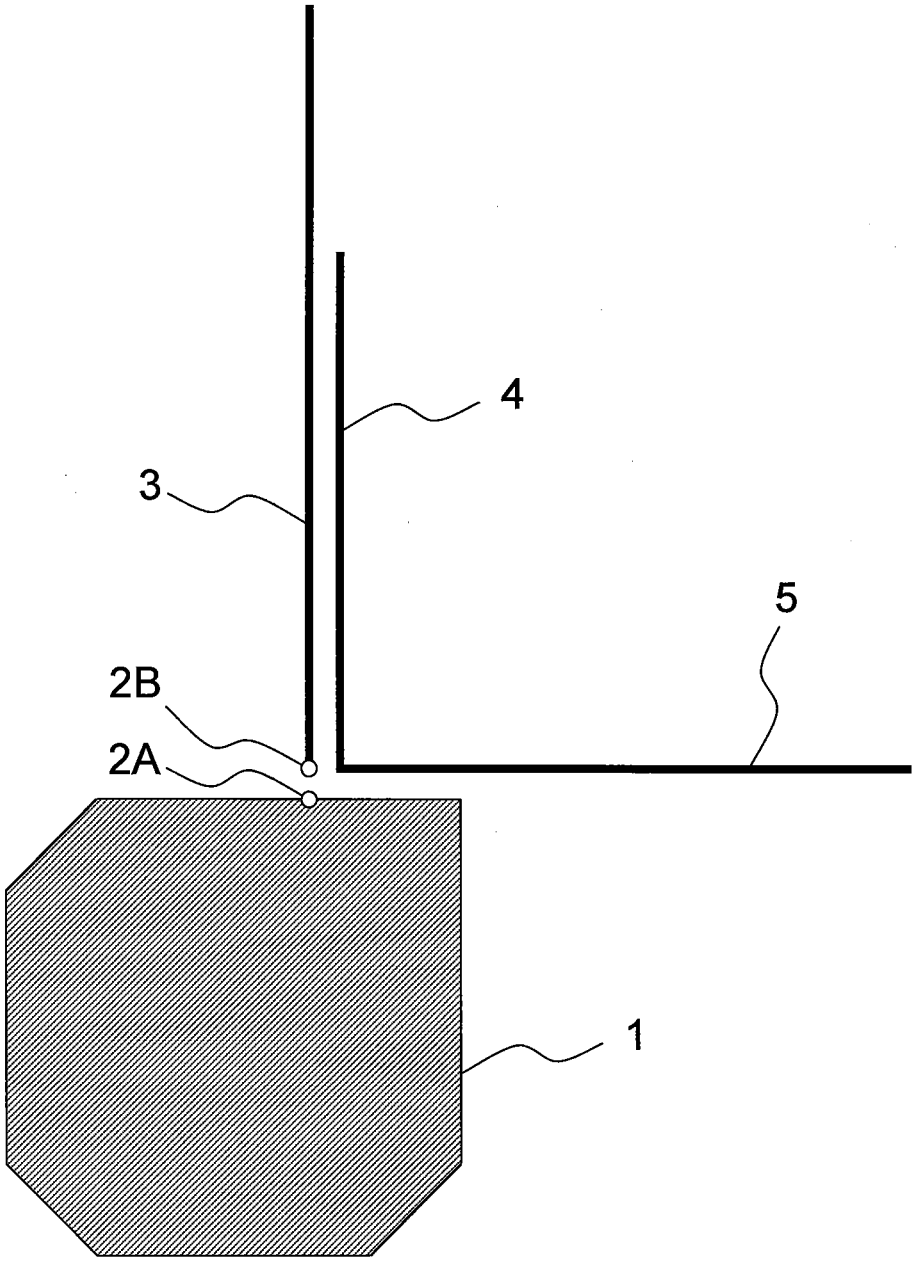
FIG. 2 is an explanatory diagram illustrating a configuration of an antenna according to a second embodiment of this invention.

FIG. 2 is an explanatory diagram illustrating a configuration of an antenna according to a second embodiment of this invention.

The second embodiment is different from the first embodiment described above in that the ground element 1 has a shape in which three corner portions of a square are truncated.

The antenna according to the second embodiment of this invention comprises a ground element 1, a first element 3, a second element 4, and a third element 5.

The ground element 1 has a heptagonal shape in which three corner portions of a square are truncated. It should be noted that, of the four corner portions of the square, the corner portion close to the third element 5 is not truncated in order to ensure electromagnetic coupling between the third element 5 and the ground element 1. Further, a second feed point 2A on a ground side is provided on the upper side of the ground element 1.

It should be noted that FIG. 2 illustrates the ground element 1 having the shape in which three corner portions are truncated out of four corner portions of a square, but the number of corner portions to be truncated may be arbitrarily determined within the range of from one to three. Further, the portion to be truncated may have various shapes other than the triangular shape.

The first element 3 extends from a first feed point 2B of the hot side, which is provided at a position opposed to the position of the second feed point 2A of the ground side, in a direction in which the first element 3 departs from the ground element 1. The second element 4 is arranged close to and in parallel with the first element 3. The third element 5 is arranged close to and in parallel with one side of the ground element 1 and extends from the lower end (end portion on a side of the ground element 1) of the second element 4.

It should be noted that the dimension and operation of each of the elements of the antenna according to this embodiment are the same as those of the first embodiment described above, and hence detailed description thereof is herein omitted.

As described above, with the antenna according to the second embodiment, the shape of the ground element 1 may be changed depending on the restraint on installation position of the antenna, and hence the degree of freedom of antenna installation can increase.

(Third Embodiment)

Figure 3:
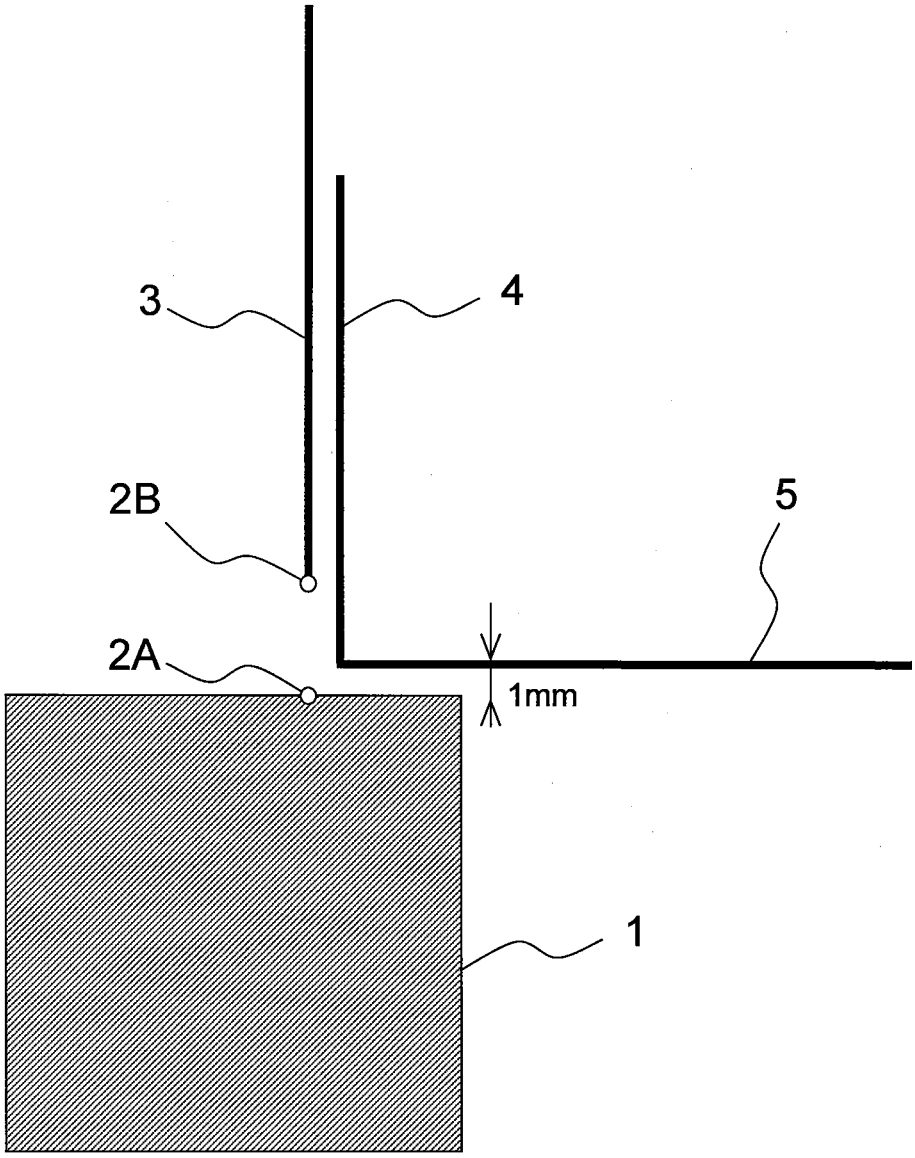
FIG. 3 is an explanatory diagram illustrating a configuration of an antenna according to a third embodiment of this invention.

FIG. 3 is an explanatory diagram illustrating a configuration of an antenna according to a third embodiment of this invention.

In the first embodiment described above, the distance between the first element 3 and the ground element 1 is the same as the distance between the third element 5 and the ground element 1. In the third embodiment, the distance between the first element 3 and the ground element 1 is different from the distance between the third element 5 and the ground element 1 instead.

As in the first embodiment, the antenna according to the third embodiment of this invention comprises a ground element 1, a first element 3, a second element 4, and a third element 5.

As in the first embodiment, the second element 4 is a linear wire conductor arranged in parallel with the first element 3. Further, the second element 4 is arranged close to the first element 3, and the distance therebetween is, for example, 1 millimeter as in the first embodiment. Therefore, the first element 3 and the second element 4 are electromagnetically coupled to each other, with the result that a high frequency current induced in the second element 4 is also induced in the first element 3 and flows through the first element 3.

The third element 5 is arranged close to and in parallel with one side of the ground element 1, and as in the first embodiment, the distance between the third element 5 and the ground element 1 is, for example, 1 millimeter. Further, the third element 5 is connected to the end portion of the second element 4 on the side of the ground element 1, and hence the high frequency current flowing through the second element 4 also flows through the third element 5.

The end portion of the first element 3 on the side of the ground element 1 is positioned farther than the third element 5 with respect to the ground element 1. In other words, the distance between the first element 3 and the ground element 1 is different from the distance between the third element 5 and the ground element 1. In this embodiment, the distance between the third element 5 and the ground element 1 is 1 millimeter, and hence the first element 3 is arranged at a position at which the distance between the first element 3 and the ground element 1 is several millimeters (for example, 2 millimeters to 10 millimeters).

A principle of operation of the antenna according to the third embodiment is the same as the principle of operation of the antenna according to the first embodiment described above, and hence description thereof is herein omitted. In other words, at the same frequency, the dimensions of the first element 3, the second element 4, and the third element 5 may be the same as the dimensions thereof described in the first embodiment. Further, as in the first embodiment, the angle defined between the first element 3 and the third element 5 is determined based on a phase delay between the first element 3 and the third element 5. As in the first embodiment, a phase difference between the first element 3 and the third element 5 is determined based on the inductive property of the first element 3 and the capacitive property of the third element 5, in other words, a difference between the length of the first element 3 and the length of the third element 5.

As described above, with the antenna according to the third embodiment, even when the first element 3 is arranged apart from the ground element 1, the first element 3 and the second element 4 are electromagnetically coupled to each other as in the first embodiment, and accordingly, based on the phase difference between the first element 3 and the third element 5, an radio wave of circular polarization can be received.

Further, in the antenna according to the third embodiment, the distance between the first element 3 and the ground element 1 may be different from the distance between the third element 5 and the ground element 1, and hence depending on a feed terminal provided between the feed point 2A of the first element 3 and the feed point 2B of the ground element 1, the position at which the first element 3 is to be arranged can be adjusted.

(Fourth Embodiment)

Figure 4:
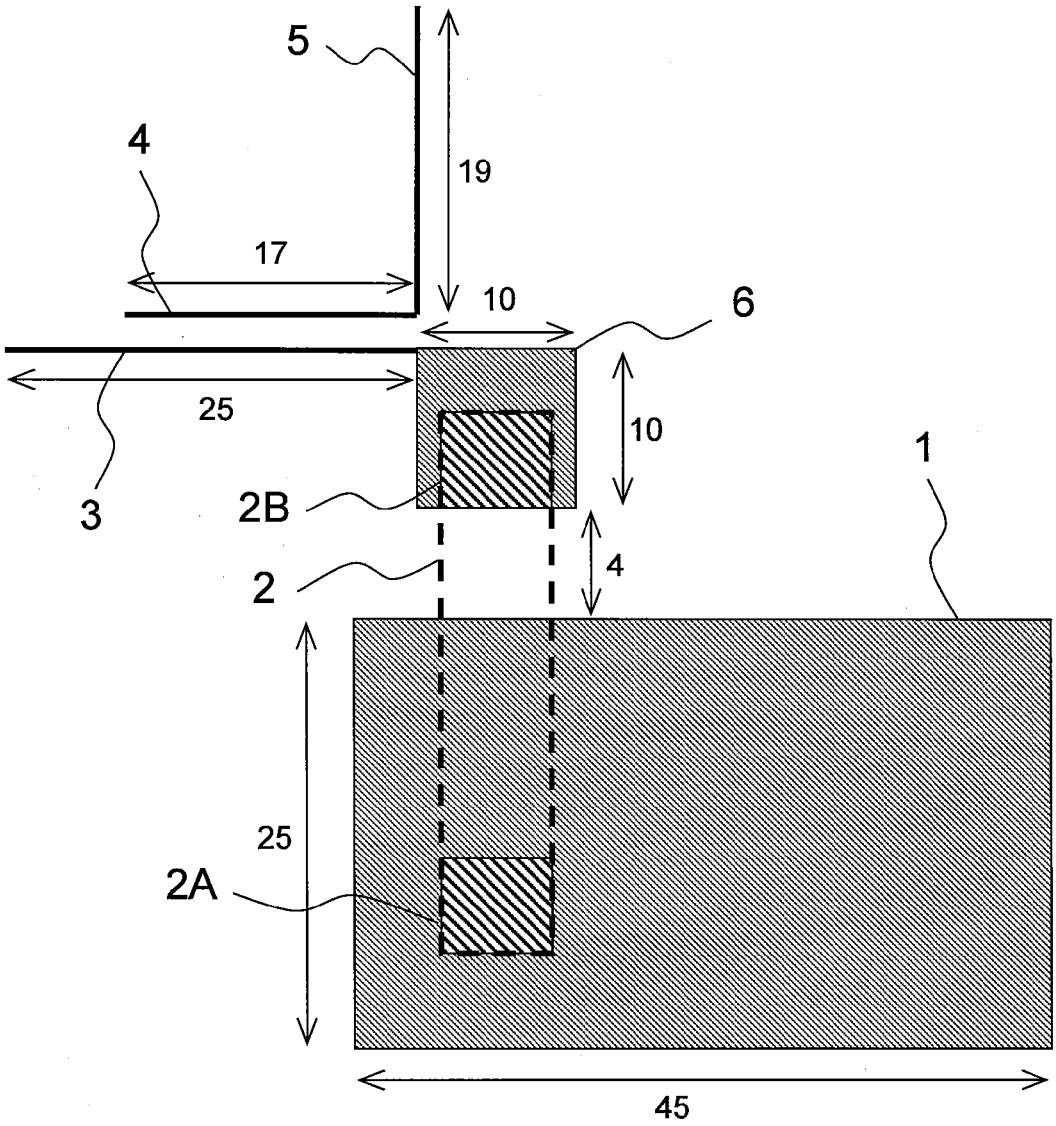
FIG. 4 is an explanatory diagram illustrating a configuration of an antenna according to a fourth embodiment of this invention.

FIG. 4 is an explanatory diagram illustrating a configuration of an antenna according to a fourth embodiment of this invention.

In the first embodiment described above, the third element 5 and the ground element 1 are arranged close to each other. The fourth embodiment is different from the first embodiment in that the third element 5 is arranged at a position at which the third element 5 is not electromagnetically coupled to the ground element 1.

As in the first embodiment, the antenna according to the fourth embodiment of this invention comprises a ground element 1, a first element 3, a second element 4, and a third element 5. It should be noted that the same components as those of the antenna according to the first embodiment are denoted by the same reference symbols, and hence description thereof is herein omitted.

The ground element 1 according to the fourth embodiment is a planar conductor (for example, has a rectangular shape as illustrated in FIG. 4), and a second feed point 2A is provided inside the ground element 1. It should be noted that the ground element 1 may have a polygonal shape other than the rectangular shape as long as an area substantially corresponding to that in the case of the rectangular shape is ensured. Further, the ground element 1 may be a wire element.

A first feed point 2B is a feed point of the hot side, which is provided on another conductor 6 than the ground element 1 so as to be associated with the second feed point 2A of the ground element 1. The first feed point 2B and the second feed point 2A are connected to a hot side and a ground side of a feed line which is connected to a feed terminal 2, respectively. It should be noted that the feed terminal 2 is connected to a receiver via a high frequency cable.

Figure 5:
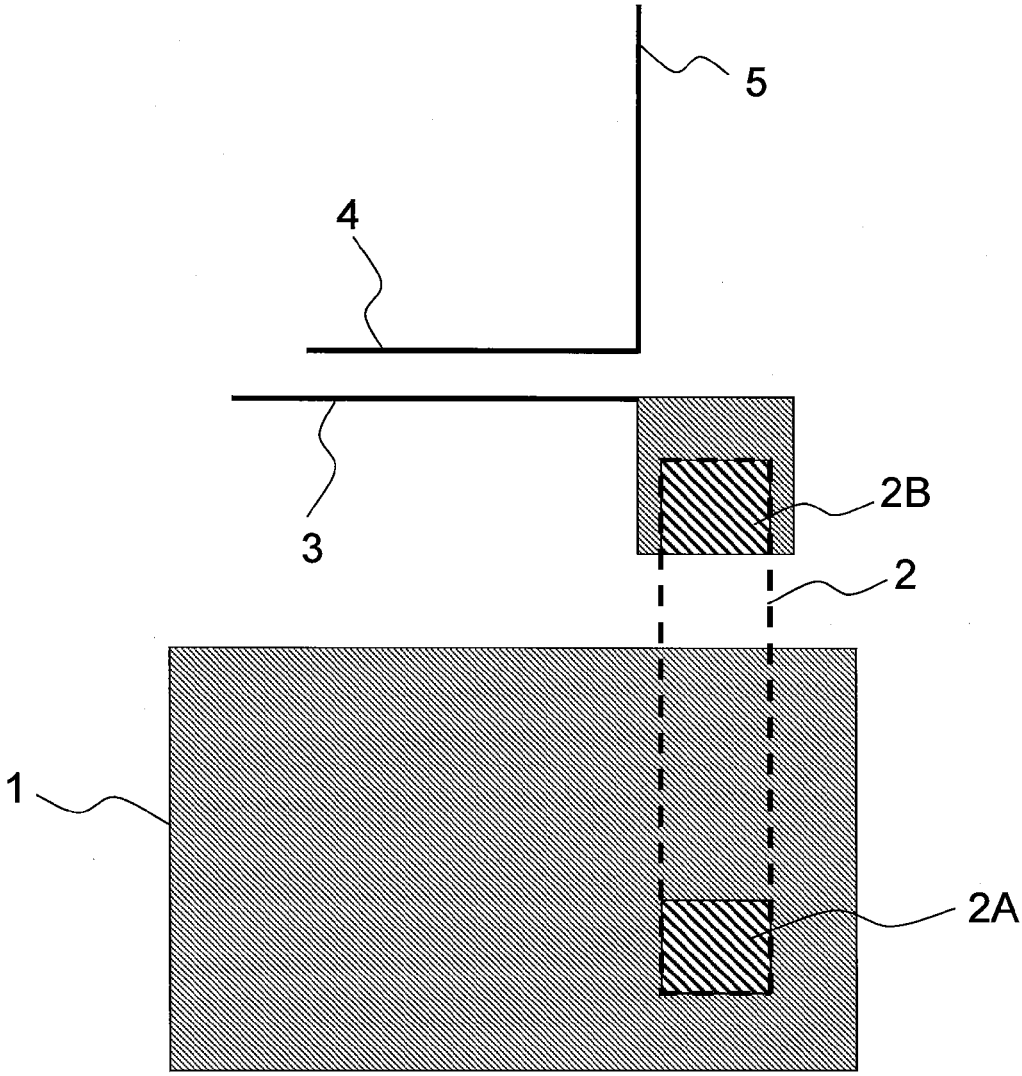
FIG. 5 is an explanatory diagram illustrating a modified example of a configuration of an antenna according to the fourth embodiment of this invention.

The conductor 6 is arranged at a position opposed to the position of the ground element 1. With regard to the positions of the conductor 6 and the ground element 1, as illustrated in FIG. 4, the conductor 6 may be arranged on a left side of the ground element 1 (in other words, at a position at which the first element 3 extends from the conductor 6 toward an outer side of the antenna), or as illustrated in FIG. 5, the conductor 6 may be arranged on a right side of the ground element 1 (in other words, at a position at which the first element 3 extends from the conductor 6 toward an inner side of the antenna).

The first element 3 is a linear wire conductor having an end portion connected to the conductor 6, and extending in a direction in which the first element 3 departs from the first feed point 2B.

As in the first embodiment described above, the second element 4 is a linear wire conductor arranged close to and in parallel with the first element 3. Therefore, the first element 3 and the second element 4 are electromagnetically coupled to each other.

The third element 5 is a wire conductor extending from an end portion of the second element 4 near the conductor 6 (first feed point 2B), in a direction in which the third element 5 departs from the first feed point 2B (in other words, in a direction in which the third element 5 and a side of the ground element 1 which is proximate to the third element 5 define a right angle). Thus, as illustrated in FIG. 4, in a case where the angle defined between the third element 5 and the second element 4 (first element 3) is a right angle, the first element 3 extends in parallel with the side of the ground element 1 which is nearest to the first element 3.

Further, as in the first embodiment, the third element 5 and the second element 4 are connected to each other, and hence a high frequency current flowing through the second element 4 also flows through the third element 5. In the fourth embodiment, the third element 5 is not arranged in parallel with the ground element 1, and the third element 5 and the ground element 1 are not electromagnetically coupled.

FIG. 4 also illustrates the length of each of the elements, which is adjusted so that the antenna according to the fourth embodiment resonates at approximately 2.3 gigahertz, but this invention is not limited to the illustrated length of each of the elements.

FIG. 5 is an explanatory diagram illustrating a modified example of a configuration of an antenna in a modification example of the fourth embodiment of this invention.

The antenna illustrated in FIG. 5 is different from the antenna illustrated in FIG. 4 in that the conductor 6 is arranged on the right side of the ground element 1. Similarly to the antenna illustrated in FIG. 4, the antenna illustrated in FIG. 5 comprises a ground element 1, a first element 3, a second element 4, and a third element 5. It should be noted that the same components as those of the antenna according to the embodiments described above are denoted by the same reference symbols, and hence description thereof is herein omitted.

In the antenna illustrated in FIG. 5, the first element 3 is arranged in parallel with one side of the ground element 1, but the first element 3 and the ground element 1 are sufficiently distant from each other, and hence no electromagnetically coupling is made therebetween. Thus, the first element 3 and the ground element 1 do not affect each other.

Further, in the antenna illustrated in FIG. 5, similarly to the antenna illustrated in FIG. 4, no electromagnetically coupling is made also between the third element 5 and the ground element 1.

The antenna according to the fourth embodiment may have any of the configurations illustrated in FIGS. 4 and 5. Specifically, the second feed point 2A may be positioned on any of the right and left sides of the ground element 1. In the fourth embodiment, the relative positions of the first to third elements 3 to 5 and the ground element 1 may be changed as long as the first element 3 and the ground element 1 are sufficiently distant from each other so that no electromagnetically coupling is made therebetween.

A principle of operation of the antenna according to the fourth embodiment is the same as the principle of operation of the antenna according to the first embodiment described above except that no capacitive coupling is made between the third element 5 and the ground element 1, and hence description thereof is herein omitted. In other words, at the same frequency, the dimensions of the first element 3, the second element 4, and the third element 5 may be the same as the dimensions thereof described in the first embodiment.

Further, as in the first embodiment, the angle defined between the first element 3 and the third element 5 is determined based on a phase delay between the first element 3 and the third element 5. As in the first embodiment, a phase difference between the first element 3 and the third element 5 is determined based on the inductive property of the first element 3 and the capacitive property of the third element 5, in other words, a difference between the length of the first element 3 and the length of the third element 5.

As described above, with the antenna according to the fourth embodiment, even when the third element 5 is arranged apart from the ground element 1, the first element 3 and the second element 4 are electromagnetically coupled to each other as in the first embodiment, and accordingly, based on the phase difference between the first element 3 and the third element 5, an radio wave of circular polarization can be received.

Further, according to the fourth embodiment, the degree of freedom of arrangement of the first to third elements 3 to 5 is ensured.

(Installation of Antenna to Vehicle)

Figure 6:
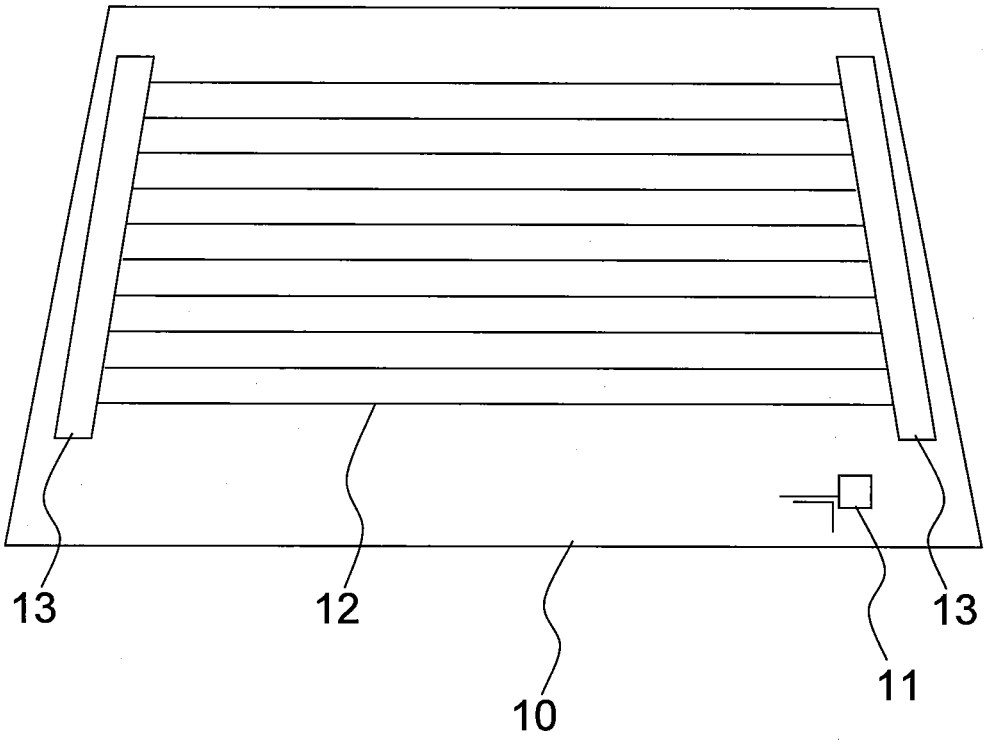
FIG. 6 is an explanatory diagram illustrating an example of the antenna of the embodiments installed on a rear glass of a vehicle.

FIG. 6 is an explanatory diagram illustrating an example in which the antenna according to the embodiments of this invention is installed on a rear glass of a vehicle.

At the center of a rear glass 10, a plurality of defogger heating wires 12 are arranged. Both ends of each of the defogger heating wires 12 are connected to bus bars 13. The bus bars 13 are connected to a power source and a ground.

An antenna 11 according to the embodiments of this invention is installed on a lower right part of the rear glass 10. It should be noted that the antenna 11 may be installed at an arbitrary position (for example, right side or left side) of the rear glass 10 as long as the antenna 11 is positioned apart from the defogger heating wires 12. It should also be noted that the antenna 11 is installed on a lower part of the rear glass 10 rather than an upper part thereof, which is convenient in order to receive radio waves arriving from an upper direction. This is because the antenna 11 is installed apart from a conductor arranged thereabove.

Further, in FIG. 6, the antenna 11 is installed in a state in which the ground element 1 is positioned on the right side of the antenna 11. The antenna according to the embodiments of this invention has an isotropic directivity, and hence may be oriented to any direction (for example, the ground element 1 may be positioned on the left side, upper side, or lower side of the antenna 11).

Figure 7:
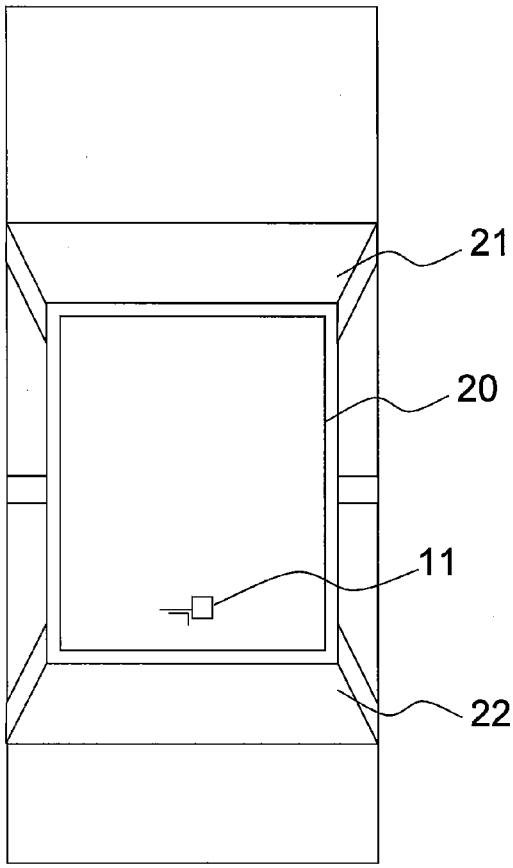
FIG. 7 is an explanatory diagram illustrating an example of the antenna of the embodiments installed on a sunroof of a vehicle.

FIG. 7 is an explanatory diagram illustrating an example in which the antenna according to the embodiments of this invention is installed on a sunroof of a vehicle. It should be noted that FIG. 7 illustrates a state in which the vehicle to which the antenna is installed is viewed from above.

The vehicle includes a wind screen 21 in the front of the vehicle cabin, a rear glass 22 in the rear of the vehicle cabin, and a sunroof 20 in the upper part of the vehicle cabin.

The antenna 11 according to the embodiments of this invention is installed on the rear center of the sunroof 20. It should be noted that the antenna 11 may be installed at an arbitrary position of the sunroof 20.

As described above, the antenna according to the embodiments of this invention can be installed even to a vehicle having the major part of its roof as a sunroof (vehicle which is small in area of a conductive part of the roof).

(Characteristics of Antenna)

Next, description is given of characteristics of the antenna according to the embodiments of this invention.

Figure 8:
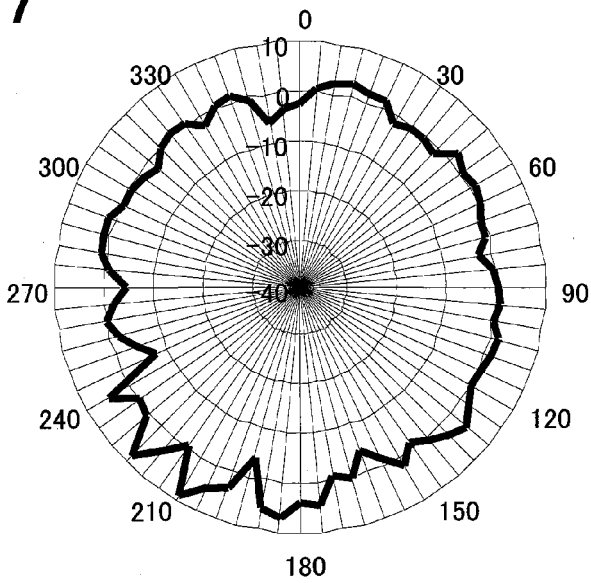
FIG. 8 is an explanatory diagram illustrating characteristics of the antenna of the embodiments.

FIG. 8 is an explanatory diagram illustrating characteristics of the antenna according to the embodiments of this invention in a case where the antenna is installed on a rear glass of a vehicle as illustrated in FIG. 6. It should be noted that an elevation angle of radio waves to be received (angle with respect to a level, at which radio waves to be received arrive) is set to 40 degrees for measurement.

As is apparent from FIG. 8, the antenna according to the embodiments of this invention has an isotropic directivity in all directions on a horizontal plane. Accordingly, the antenna according to the embodiments of this invention can receive satellite broadcasting waves arriving from various directions reliably.

While the present invention has been described in detail and pictorially in the accompanying drawings, the present invention is not limited to such detail but covers various obvious modifications and equivalent arrangements, which fall within the purview of the appended claims.

What is claimed is:

1. An antenna, comprising:

a first element connected to a first feed point of a hot side;

a ground element connected to a second feed point of a ground side;

a second element; and a third element;

wherein the second element is arranged substantially in parallel with the first element so as to be electromagnetically coupled to the first element, said second element being separate from said first element, wherein the third element is arranged to define a predetermined angle with the first element, with a vertex of the predetermined angle set to a vicinity of the first feed point and the second feed point, said third element being separate from said first element, wherein the first element has a linear shape so as to have an inductive property at a predetermined resonance frequency, wherein the third element has a linear shape so as to have a capacitive property at the predetermined resonance frequency, wherein the first feed point and the second feed point are adjacent to each other, wherein the third element is connected to a ground-side end portion of the second element, and wherein the second element and the third element are not directly connected to the ground element.

2. The antenna according to claim 1, wherein the predetermined angle defined between the first element and the third element is an angle corresponding to a phase delay between a current induced in the first element and a current induced in the third element, the delay being caused by a difference between a length of the first element and a length of the third element.

3. The antenna according to claim 1, wherein the length of the first element is larger than $\lambda/4$ of the predetermined resonance frequency;

wherein the length of the third element is smaller than $\lambda/4$ of the predetermined resonance frequency; and wherein the predetermined angle defined between the first element and the third element is substantially 90 degrees.

4. The antenna according to claim 1, wherein the third element extends in a direction in which the third element departs from the ground element; and wherein the first element is arranged substantially in parallel with one side of the ground element.

5. The antenna according to claim 1, wherein a portion of the third element adjacent to a point at which the third element is connected to the second element is positioned adjacent to the ground element so that the third element is electromagnetically coupled to the ground element.

6. The antenna according to claim 5, wherein the first feed point is positioned farther from the ground element than the point at which the third element is connected to the second element.

7. The antenna according to claim 1, wherein the ground element has a polygonal shape with at least one side adjacent to the third element.

8. The antenna according to claim 1, wherein the ground element has a planar shape having a wide conductive surface.

* * * * *